US009314827B2

(12) United States Patent
Atalla et al.

(10) Patent No.: US 9,314,827 B2
(45) Date of Patent: Apr. 19, 2016

(54) METHOD AND APPARATUS FOR APPLYING A LUBRICANT WHILE ROLLING METALLIC ROLLED STOCK

(75) Inventors: Valentin Atalla, Haslach (AT); Jian Chen, St. Marien (AT); Gernot Dirisamer, Grieskirchen (AT); Manfred Eder, Thalheim bei Wels (AT); Kurt Haller, Vorchdorf (AT); Konrad Krimpelstätter, Katsdorf (AT); Krzysztof Mazurowski, Linz (AT)

(73) Assignee: SIEMENS VAI METALS TECHNOLOGIES GMBH (AT)

( * ) Notice: Subject to any disclaimer, the term of this patent is extended or adjusted under 35 U.S.C. 154(b) by 285 days.

(21) Appl. No.: 13/995,028

(22) PCT Filed: Sep. 2, 2011

(86) PCT No.: PCT/EP2011/065165

§ 371 (c)(1),
(2), (4) Date: Jul. 31, 2013

(87) PCT Pub. No.: WO2012/079785

PCT Pub. Date: Jun. 21, 2012

(65) Prior Publication Data

US 2013/0298627 A1 Nov. 14, 2013

(30) Foreign Application Priority Data

Dec. 16, 2010 (EP) ..... 10195330

(51) Int. Cl.
*B21B 27/06* (2006.01)
*B21B 27/10* (2006.01)
*B21B 45/02* (2006.01)

(52) U.S. Cl.
CPC ..... *B21B 27/06* (2013.01); *B21B 27/10* (2013.01); *B21B 45/0251* (2013.01)

(58) Field of Classification Search
CPC .... B21B 27/06; B21B 27/10; B21B 45/0239; B21B 45/0245; B21B 45/0251; B21B 45/0233; B05B 7/0483; B05B 1/04; B05B 1/042; B05B 1/14; B05B 1/26; B05B 1/3489; B05B 1/36; B05B 7/04; B01F 5/20; B01F 3/04049
See application file for complete search history.

(56) References Cited

U.S. PATENT DOCUMENTS 2,960,064 A 11/1960 Lewis ..... 118/302
5,685,706 A * 11/1997 Hersh et al. ..... 431/8

(Continued)

FOREIGN PATENT DOCUMENTS

CN 1537035 10/2004
CN 101821026 9/2010

(Continued)

OTHER PUBLICATIONS

International Search Report and International Preliminary Report on Patentability, Application No. PCT/EP2011/065165, 17 pages, Jun. 12, 2011.

(Continued)

*Primary Examiner* — Teresa M Ekiert
(74) *Attorney, Agent, or Firm* — Ostrolenk Faber LLP

(57) ABSTRACT

A method for applying a lubricant while rolling metallic rolled stock, e.g., a rolled strip guided through a roll gap between two work rolls, may include the following steps: producing a mixture of lubricant and a carrier gas in an atomization device; supplying the mixture to individual spray nozzles of an arrangement of spray nozzles, in order to produce a continuous overall spray jet in the direction of the width of the rolled strip; and applying the mixture by means of the overall spray jet to the surface of at least one of the work rolls and/or to the surface of the rolled strip.

18 Claims, 4 Drawing Sheets

(56) References Cited

U.S. PATENT DOCUMENTS

| | | | | |
|---|---|---|---|---|
| 7,159,433 | B2 | 1/2007 | Seidel | |
| 8,544,608 | B2 | 10/2013 | Vervaet et al. | |
| 2006/0180682 | A1* | 8/2006 | Burato et al. | 239/552 |
| 2011/0036555 | A1 | 2/2011 | Plicht et al. | |
| 2011/0111124 | A1 | 5/2011 | Pawelski et al. | 427/255.25 |
| 2014/0060135 | A1 | 3/2014 | Pawelski et al. | |

FOREIGN PATENT DOCUMENTS

| | | | | |
|---|---|---|---|---|
| CN | 101842171 | | 9/2010 | |
| DE | 102008050392 | A1 | 12/2009 | B21B 27/06 |
| RU | 81 911 | U1 | 4/2009 | |
| SU | 1227275 | A1 | 4/1986 | |
| SU | 1311798 | A1 | 5/1987 | |
| WO | 2012/079785 | A1 | 6/2012 | B05B 1/14 |

OTHER PUBLICATIONS

Chinese Office Action dated Jul. 23, 2014 corresponding to Chinese Application No. 201180060262.1 (14 pages).

Russian Decision to Grant dated Jul. 2, 2015 issued in corresponding Russian Patent Application No. 2013132745/02(048947).

* cited by examiner

METHOD AND APPARATUS FOR APPLYING A LUBRICANT WHILE ROLLING METALLIC ROLLED STOCK

CROSS-REFERENCE TO RELATED APPLICATIONS

This application is a U.S. National Stage Application of International Application No. PCT/EP2011/065165 filed Sep. 2, 2011, which designates the United States of America, and claims priority to EP Patent Application No. 10195330.5 filed Dec. 16, 2010. The contents of which are hereby incorporated by reference in their entirety.

TECHNICAL FIELD

This disclosure relates generally to the technical field of rolling of metallic rolling stock, in particular a rolled strip which is fed through a rolling aperture between two working rolls, wherein a lubricant is used for the purpose of lubrication.

BACKGROUND

It is known that in the rolling of metallic rolling stock, for example metal strip, liquid or gaseous treatment media are used for lubricating and cooling purposes. These treatment media are different depending on the type of rolling process: in the case of hot rolling, in which the rolling stock is heated up to several 100° C., a water-oil emulsion is usually used; in the case of cold rolling, in which the temperature of the rolling stock before the rolling operation is usually below 100° C., the lubrication in the rolling aperture is mostly effected by a cold-rolling oil, with a coolant liquid being used in addition.

Although the rolling liquid which is introduced is collected, in the case of both hot rolling and cold rolling, at the base of the roll stand, and can in principle be reused in the rolling process after reprocessing, it is endeavored to keep the usage of lubricants and coolants as small as possible.

SUMMARY

One embodiment provides a method for applying a lubricant during the rolling of metallic rolling stock, in particular a rolled strip which is fed through a rolling aperture between two working rolls, comprising: production of a mixture of lubricant and a carrier gas in an atomizing device; feeding of the mixture to individual spray nozzles in an arrangement of spray nozzles in order to produce an overall spray jet which is contiguous across the width of the rolled strip, wherein the overall spray jet is made up of spray jets which in cross-section are essentially flat in form; and application of the overall spray jet to the surface of at least one of the working rolls and/or to the surface of the rolled strip.

In a further embodiment, each spray jet is formed by means of a spray nozzle which has an orifice piece with at least two discharge openings.

In a further embodiment, use is made of a spherically curved orifice piece with at least two discharge openings which are arranged symmetrically with respect to an axis of symmetry.

In a further embodiment, in the application of the overall spray jet, use is made of an arrangement of spray nozzles which are arranged in a row on a spray bar, and wherein each of the spray nozzles produces a spray jet which, viewed in cross-section, is essentially flat in form and wherein each of the spray jets is aligned, when looking across its width, roughly parallel to the axis of a working roll.

In a further embodiment, air is used as the carrier gas.

In a further embodiment, a rolling oil is used as the lubricant.

In a further embodiment, in the production of the mixture, rolling oil and air are fed to the atomizing device at a temperature which corresponds to the ambient temperature.

In a further embodiment, the rolling oil is fed to the atomizing device by means of a dosing pump.

In a further embodiment, the amount of rolling oil fed is less than 200 ml per minute.

Another embodiment provides an apparatus for applying a lubricant into the roll aperture of a roll stand, wherein a metallic rolled strip is fed through the roll aperture, incorporating: an atomizing device to which is fed the lubricant and a carrier gas in order to produce a mixture of lubricant and carrier gas; and an arrangement of spray nozzles which are connected to the atomizing device and to each of which the mixture is fed via connecting lines, wherein the arrangement is chosen such that each spray nozzle produces a spray jet which, viewed in cross-section is essentially flat in form, and which is directed onto the surface of a working roll and/or onto the surface of the rolled strip.

In a further embodiment, each spray nozzle has an orifice piece with at least two discharge openings which are adjusted to produce a spray jet which, in cross-section, is essentially flat in form.

In a further embodiment, the orifice piece is spherically curved in the region where the at least two discharge openings are formed.

In a further embodiment, in the region where the curvature of the orifice piece is spherical, two discharge openings are formed which are symmetrical with respect to an axis symmetry.

In a further embodiment, the two discharge openings are C-shaped in form with limbs which point away from the axis of symmetry.

In a further embodiment, each of the discharge openings has a width, this width being less than one millimeter, preferably 0.6 to 0.7 mm.

In a further embodiment, the arrangement of the spray nozzles is chosen such that the individual spray jets from the spray nozzles form a contiguous overall spray jet which is directed onto the surface of a working roll and has a long side which is aligned roughly parallel to the axis of the working roll.

In a further embodiment, the lubricant is a rolling oil and the carrier gas is air.

In a further embodiment, the rolling oil is fed to the atomizing device by means of a dosing pump.

In a further embodiment, the dosing pump feeds the rolling oil to the atomizing device with a volumetric flow rate of less than 200 ml per minute.

In a further embodiment, the rolling oil has a temperature which corresponds roughly to the ambient temperature of the roll stand.

In a further embodiment, each of the two discharge openings is formed by an incision in the orifice piece which lies in a plane, wherein the planes are at an angle to one another.

BRIEF DESCRIPTION OF THE DRAWINGS

Example embodiments are discussed in detail below, with reference to the drawings, in which.

DETAILED DESCRIPTION

Figure 1:
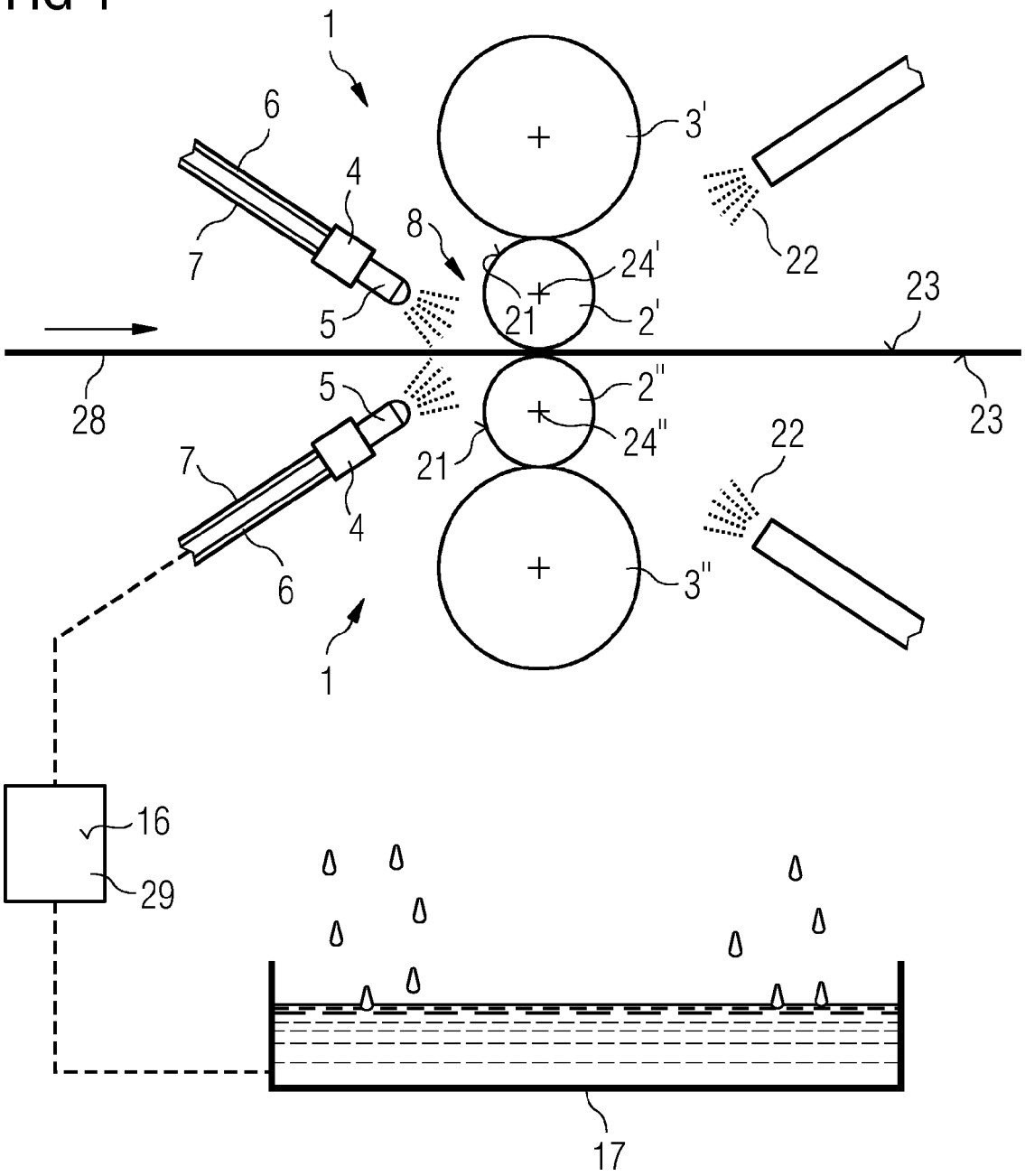
FIG. 1 shows a schematic vertical section through a roll stand of the arrangement of the disclosed apparatus for introducing a lubricant into the roll aperture.

Embodiments of the present invention provide a method and apparatus for applying a lubricant during the rolling of metallic rolling stock, with which the lubricant usage is as small as possible.

The medium used for the lubrication of the roll aperture is not a rolling fluid but a spray, that is to say a mixture of rolling oil and a carrier gas. The lubricant is broken up into finely distributed liquid drops in an atomizer, and is introduced into the roll aperture by means of the carrier gas. As appropriate, this application or introduction into the roll aperture can be effected either by spraying onto the surface of the working rolls and/or onto the surface of the rolling stock which is passing into the roll aperture. The lubricant usage can be kept comparatively small by the homogeneous application of the lubricant as a spray. The lubricant, which is present in the form of droplets, effects very selective wetting of only those areas of the surface of the working rolls and/or rolling stock which are significant in determining the friction during rolling. Here, the only critical factor is that a sufficient quantity of oil for the purpose of lubrication gets into the roll aperture; this can basically be achieved by spraying onto the surface of the working rolls or onto the surface of the rolled strip passing into the rolls, or onto both surfaces. By comparison with an emulsion, the concentration of the lubricant in the roll aperture is significantly higher. This increases the efficiency of the lubricant used, because the rolling oil which passes into the roll aperture is exactly the amount required, depending on the nature of the rolling stock, to reduce the friction in the roll aperture. Looking in the direction across the width of the rolled strip, the disclosed method and apparatus permits a uniform application of the lubricant. This reduces the danger that different frictional conditions arise in the roll aperture in the widthwise direction. Particularly in the case of cold rolling this is especially advantageous, because the desired final thickness of the metal is comparatively small and a local break in the lubricating film can easily arise. In addition, in the case of cold rolling a good surface finish on the metal strip is generally an objective, a prerequisite for which is adequate lubrication in the roll aperture. A further advantage can be seen in that the lubricant is used in a pure form, that is not in the form of an emulsion, so that no emulsifying agent is required in the lubricant. This gives the advantage that the oil can be relatively easily separated from the coolant, e.g. water, and can be reused, if necessary after reprocessing, i.e. can be fed round in a circulation.

The application of the lubricant may be effected through individual spray nozzles which are arranged in a row and each of which produces a spray jet which, looking at its cross-section, is essentially flat in form. In the region of their edges, the individual cross-sections can then overlap one another. In this way, looking across the width of the rolled strip, a fan-shaped overall spray jet can be produced, with which the lubricant can be introduced into the roll aperture homogeneously and selectively. In order to achieve a distribution of the lubricant which is as homogeneous as possible across the cross-sectional area of the spray jet, it is expedient if the spray nozzles used have at least two discharge openings. Depending on the shape of these at least two discharge openings, it is possible to achieve very good uniformity in the surface concentration in the application of the lubricant.

For a uniform application of lubricant, it can be expedient if nozzles are used which have a spherically curved orifice piece. Provided on this curved orifice piece are two C-shaped slots which, relative to an axis of symmetry, are embodied as symmetrical. By this means it is possible, using a comparatively small number of nozzles, to form a spray which applies the lubricant uniformly. The depth and angular positioning of these slots can be used to influence the cross-section of these spray jets.

In order to introduce the lubricant as efficiently as possible into the roll aperture, it can be advantageous if the spray is formed from a series of adjacent individual spray jets, wherein the alignment of each of these spray jets, looking in the direction of its width, is roughly parallel to the axis of the two working rolls.

In one embodiment of the method, air can be used as the carrier medium for the lubricant droplets.

With respect to the energy use, it can be of particular advantage if the rolling oil used is not heated but is used essentially at a temperature which corresponds to the ambient temperature.

FIG. 1 shows a greatly simplified diagram of a vertical section through a roll stand. The roll stand consists essentially of the two working rolls 2' and 2", together with their associated backup rolls 3' and 3". A rolled strip 28 is fed through the roll aperture 8 between the two working rolls 2' and 2" in the direction indicated by the arrow, from left to right. Sketched on the input side, on each of the upper and lower sides of the rolled strip 28, is the disclosed apparatus 1, which sprays atomized rolling oil towards the roll aperture 8. Atomization of the rolling oil takes place in each case in an atomizing device 4, to which are fed rolling oil and air through lines 6 and 7 respectively.

As explained in more detail below, in the atomizing device 4 a mixture is formed of air and lubricant particles, which is applied as a spray by means of an arrangement of spray nozzles 5. This spray precipitates onto the surface 21 of the working rolls 2' and 2" and/or onto the surface 23 of the rolled strip 28, thereby effecting the desired reduction in the frictional characteristics in the roll aperture 8. Rolling oil is collected together with the coolant in the trough 17, and is recycled by means of a pumping and reprocessing system.

Figure 2:
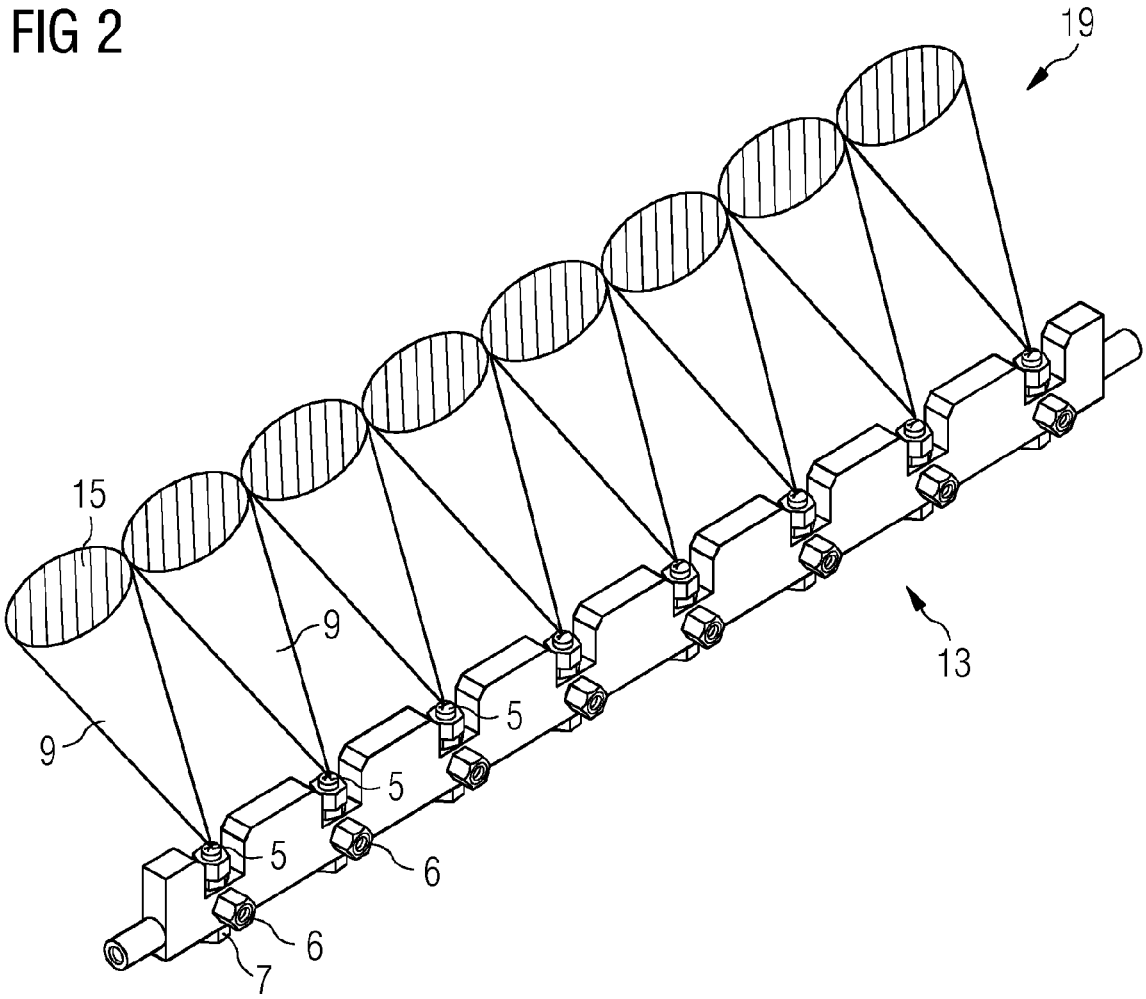
FIG. 2 shows a 3-dimensional diagram of a spray bar with a series of adjacent spray nozzles, wherein the overall spray jet made up of the individual spray jets is sketched.

FIG. 2 shows an arrangement of spray nozzles 5 on a spray bar 13. To each spray nozzle 5 is fed respectively rolling oil via a first line 6 and air via a second line 7. Each spray nozzle 5 produces a spray jet 9, which is flat when viewed in cross-section 15. The arrangement as an adjacent series of these individual flat spray jets 9 forms an overall spray jet 19 which is homogeneous in terms of the oil concentration.

Figure 3:
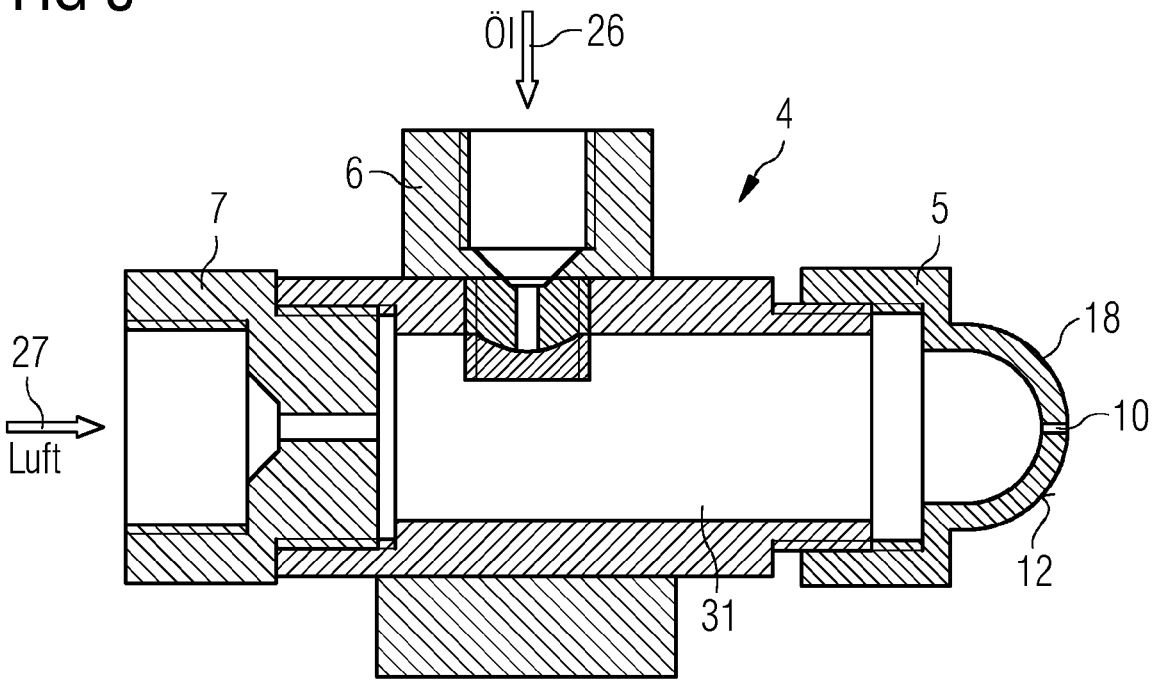
FIG. 3 shows a sectional diagram of an atomization device together with a spray nozzle.

FIG. 3 shows a sectional drawing of the atomizing device 4. As already stated, this atomizing device 4 has fed to it rolling oil via a connecting line 6, and air via a connecting line 7, respectively. The oil-air mixture is produced in a manner which is known per se: the two media, air 27 and oil 26, meet each other in a swirl chamber 31. The air 27, which flows at high speed past a restrictor in the rolling oil feed line 6, drags with it oil particles 26, so that a mixture of air and finely distributed droplets of liquid oil forms in the swirl chamber 31. Here, the size and form of these liquid droplets can each be adjusted over a wide range by the amount of the media fed in and by restrictors. In the atomizing device 4, these restrictors in the air and oil feeds are exchangeable. This makes it possible to produce a mixture of air and liquid particles which is suitable for the requirement. This mixture is fed via a short connecting piece to a spray nozzle 5. The spray nozzle 5 is spherically curved in the region of an orifice 18. In the region of the spherical curvature 12, two discharge openings 10 are formed. Each of these discharge openings 10 is formed by a slot in the region of the orifice 18. This slot in the spherical curvature 10 can be simply manufactured by an incision with a saw blade.

Figure 4:
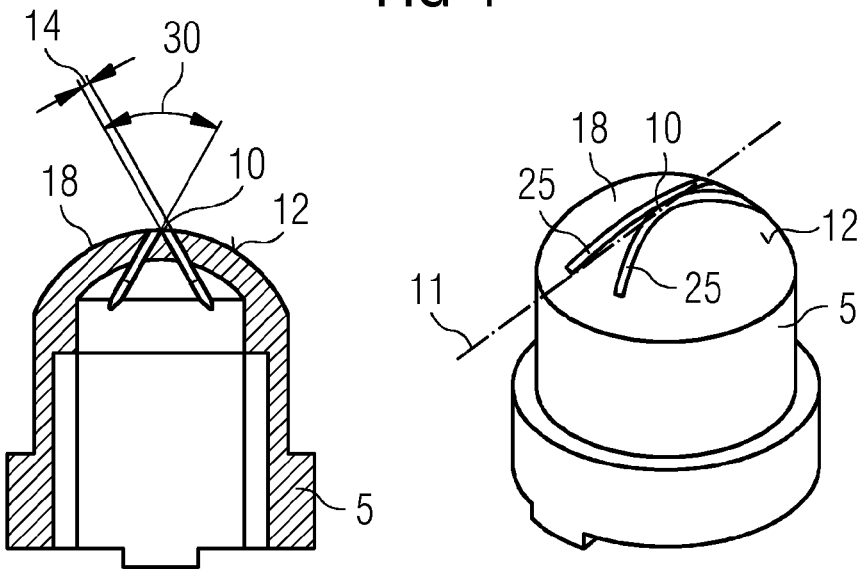
FIG. 4 shows a form of embodiment of the orifice piece of a spray nozzle, shown as a 3-dimensional and a sectional diagram.

FIG. 4 shows two views of the orifice piece 18: the upper diagram is a sectional view of the orifice piece 18, the lower diagram shows a 3-dimensional view of it. The orifice piece 18 has a curvature which is convex to the outside. In the present form of embodiment, the curvature 12 is an arc of a circle. A corresponding curvature is also formed on the inner wall of the orifice piece 18. At the high point of the curvature 12 can be seen two discharge openings 10 for the mixture, formed by incisions, each of which—looking in a direction opposite to the direction of outflow—has the shape of a "C". The arrangement of these two C-shaped discharge openings 10 is here chosen such that the limbs 25 of the two "C"s point away from an axis of symmetry 11. Expressed in another way, the two "C" incisions lie back-to-back. These discharge openings 10 are manufactured by incisions. The planes of the incisions 10 lie at an angle 30 to each other. Advantageously, the slot width 14 of these incisions is between about 0.6 and 0.7 mm. Forming the orifice region of the spray nozzle 5 in this way achieves the effect that a spray jet 9 is formed which has a flat cross-sectional area and a largely homogeneous distribution of the lubricant concentration.

Figure 5:
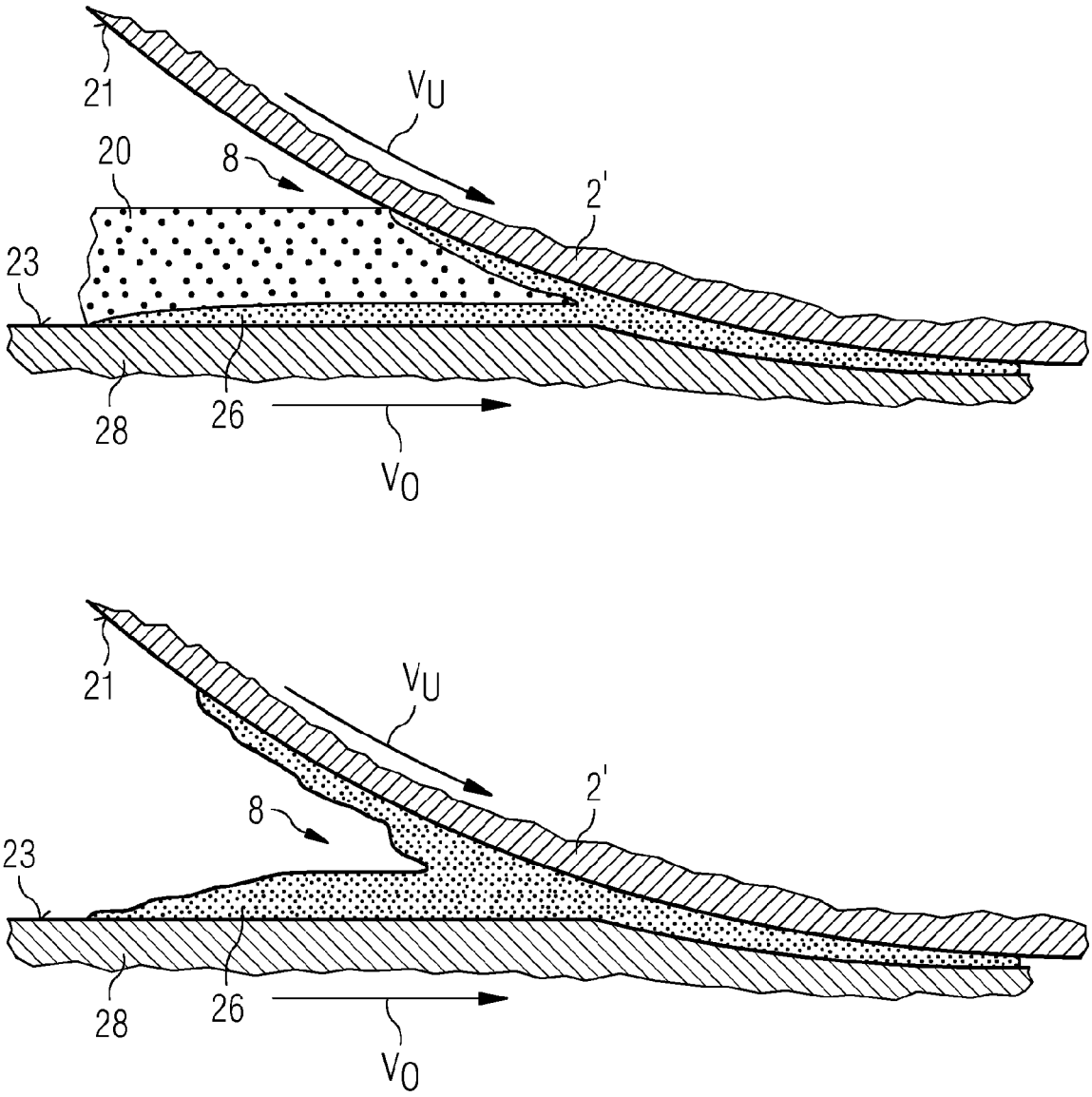
FIG. 5 shows a detail diagram of the roll aperture lubrication, as a diagram comparing lubrication using an emulsion and lubrication using rolling oil.

FIG. 5 shows a greatly simplified diagram of the lubrication in the roll aperture, wherein the upper diagram shows the lubrication using an emulsion in accordance with the prior art, the lower diagram shows the inventive application of the rolling oil by means of a spray. Although lubricant 26 is also deposited on the surface 21 of the working rolls 2', 2" and on the surface 23 of the rolled strip 8 with emulsion lubrication, a result of the emulsion 20 is that the concentration of lubricant in the roll gap 8 is lower than when the lubricant is introduced in the form of a spray, which is shown in the lower diagram in FIG. 5.

According to the disclosed techniques, a higher concentration of lubricant forms in the roll aperture 8 compared with emulsion lubrication. Depending on the rolling speed, the roughness of the rolls and other process variables, a comparatively low oil consumption of between 50 ml per minute and 200 ml per minute and per roll stand can be achieved. In the manufacture of rolled strip, this is a substantial cost advantage. A further advantage arises from the very greatly reduced friction in the roll aperture, as a result of which the rolling forces and the rolling torques for the rolling process can be reduced. In particular in the case of cold rolling, it is possible to achieve a very good surface finish on the rolled strip.

SUMMARY OF THE REFERENCE MARKS USED

1 Apparatus for applying a lubricant
2', 21" Working rolls
3', 41 Backup rolls
4 Atomizing device
5 Spray nozzle
6 Line (lubricant)
7 Line (carrier gas)
8 Roll aperture
9 Spray jet
10 Discharge opening
11 Axis of symmetry
12 Curvature
13 Spray bar
14 Slot width
15 Cross-section
16 Pumping and reprocessing system
17 Trough
18 Orifice piece
19 Overall spray jet
20 Emulsion
21 Surface of the working roll
22 Coolant
23 Surface of the rolled strip
24', 24" Axis of the working roll 2', 2"
2 5 Limb
26 Lubricant, rolling oil
27 Carrier gas, air
28 Rolled strip
29 Dosing pump
30 Angle
31 Swirl chamber

What is claimed is:

1. A method for applying a lubricant during the rolling of a rolled strip which is fed through a rolling aperture between two working rolls the method comprising:

producing a mixture of lubricant and a carrier gas in an atomizing device;

feeding the mixture to individual spray nozzles in an arrangement of spray nozzles to produce an over-all spray jet that is contiguous across a width of the rolled strip, wherein the overall spray jet comprises spray jets having an essentially flat cross-section;

applying the overall spray jet to the surface of at least one of the working rolls and/or to the surface of the rolled strip, wherein each spray nozzle includes an orifice piece having a convex exterior surface with at least two discharge openings arranged on the orifice piece to produce a spray jet having an essentially flat cross-section, wherein said openings are C-shaped, symmetrical slots when viewed in a direction opposite to direction of outflow of lubricant, wherein each slot is located on a respective side of an axis of symmetry of said orifice piece, wherein each slot is an incision in the orifice piece which lies in a plane, wherein the respective planes of the at least two slots are at an angle to one another, wherein the at least two discharge openings have limbs pointing away from the axis of symmetry, and wherein the slots are adjacent one another at the apex of said convex exterior surface.

2. The method of claim 1 wherein the arrangement of spray nozzles are arranged in a row on a spray bar, and wherein each of the spray jets has a width parallel to an axis of a working roll.

3. The method of claim 1, wherein the carrier gas is air.

4. The method of claim 1, wherein the lubricant comprises a rolling oil.

5. The method of claim 1, wherein the production of the mixture comprises feeding rolling oil and air to the atomizing device at a temperature that corresponds to the ambient temperature.

6. The method of claim 5, comprising feeding the rolling oil to the atomizing device using a dosing pump.

7. The method of claim 6, comprising feeding the rolling oil at a rate in the range 50 ml per minute to 200 ml per minute.

8. The method of claim 1, wherein the slots are back-to-back.

9. The method of claim 1, wherein the angle is more than ten degrees.

10. Apparatus for applying a lubricant into the roll aperture of a roll stand, the roll aperture configured for receiving a metallic rolled strip being fed there through, the apparatus comprising:

an atomizing device to which the lubricant and a carrier gas is fed to produce a mixture of lubricant and carrier gas; and an arrangement of spray nozzles which arc connected to the atomizing device, wherein the mixture is fed to each spray nozzle via connecting lines, wherein the arrangement is configured such that each spray nozzle produces a spray jet having an essentially flat cross-section, and which spray jet is directed onto at least one of a surface of a working roll and a surface of the rolled strip, wherein each spray nozzle includes an orifice piece having a convex exterior surface with at least two discharge openings arranged on the orifice piece to produce a spray jet having an essentially flat cross-section, wherein said openings are C-shaped, symmetrical slots when viewed in a direction opposite to direction of outflow of lubricant, wherein each slot is located on a respective side of an axis of symmetry of said orifice piece, wherein each slot is an incision in the orifice piece which lies in a plane, wherein the respective planes of the at least two slots are at an angle to one another, wherein the at least two discharge openings have limbs pointing away from the axis of the symmetry, and wherein the slots are adjacent one another at the apex of said convex exterior surface.

11. The apparatus of claim 10, wherein each discharge opening has a width equal to or more than 0.6 mm but less than one millimeter.

12. The apparatus of claim 10, wherein the arrangement of the spray nozzles is configured such that the individual spray jets from the spray nozzles form a contiguous overall spray jet which is directed onto the surface of a working roll and has a long side aligned generally parallel to an axis of the working roll.

13. The apparatus of claim 10, wherein the lubricant is a rolling oil and the carrier gas is air.

14. The apparatus of claim 13, comprising a dosing pump configured to feed the rolling oil to the atomizing device.

15. The apparatus of claim 14, wherein the dosing pump is configured to feed the rolling oil to the atomizing device with a volumetric flow rate in the range of 50 ml per minute to 200 ml per minute.

16. The apparatus of claim 14, wherein the rolling oil has a temperature which corresponds generally to an ambient temperature of the roll stand.

17. The apparatus of claim 10, wherein the slots are back-to-back.

18. The method of claim 10, wherein the angle is more than ten degrees.

* * * * *